US006423143B1

(12) United States Patent
Allen et al.

(10) Patent No.: US 6,423,143 B1
(45) Date of Patent: Jul. 23, 2002

(54) VOLTAGE BLOCK MONITORING SYSTEM

(75) Inventors: Harold T. Allen, Indianapolis; Varce E. Howe, Zionsville; Jerry L. McPherson, Jr., Greenfield; Roy E. Young, II, Avon, all of IN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/432,330

(22) Filed: Nov. 2, 1999

(51) Int. Cl.[7] ..... B05B 5/025

(52) U.S. Cl. ..... 118/621; 118/684; 118/300; 118/506; 427/458

(58) Field of Search ..... 118/668, 676, 118/679, 684, 621, 300, 308, 506; 427/458

(56) References Cited

U.S. PATENT DOCUMENTS

| | | | | |
|---|---|---|---|---|
| 1,655,262 | A | | 1/1928 | Fortin |
| 2,547,440 | A | | 4/1951 | Clark et al. |
| 2,673,232 | A | | 3/1954 | Silsby |
| 2,814,551 | A | | 11/1957 | Broetze et al. |
| 2,921,604 | A | | 1/1960 | Zettl |
| 3,098,890 | A | | 7/1963 | Peterson |
| 3,122,320 | A | | 2/1964 | Beck et al. |
| 3,291,889 | A | | 12/1966 | Uline et al. |
| 3,419,827 | A | | 12/1968 | Webb |
| 3,450,092 | A | | 6/1969 | Kock |
| 3,838,946 | A | | 10/1974 | Schall |
| 3,893,620 | A | | 7/1975 | Rokadia |
| 3,933,285 | A | | 1/1976 | Wiggins |
| 3,934,055 | A | | 1/1976 | Tamny |
| 4,017,029 | A | | 4/1977 | Walberg |
| 4,020,866 | A | | 5/1977 | Wiggins |
| 4,030,860 | A | | 6/1977 | Standlick |
| 4,085,892 | A | | 4/1978 | Dalton |
| 4,232,055 | A | | 11/1980 | Shaffer |
| 4,275,834 | A | | 6/1981 | Spanjersberg et al. |
| 4,304,252 | A | | 12/1981 | Stanton |
| 4,313,475 | A | | 2/1982 | Wiggins |
| 4,381,180 | A | | 4/1983 | Sell |
| 4,383,644 | A | | 5/1983 | Spanjersberg et al. |
| 4,386,888 | A | | 6/1983 | Verley |
| 4,413,788 | A | | 11/1983 | Schaefer et al. |
| 4,515,516 | A | | 5/1985 | Perrine et al. |
| 4,536,140 | A | * | 8/1985 | Guthrie ..... 417/500 |
| 4,552,334 | A | | 11/1985 | Tomiyama et al. |

(List continued on next page.)

FOREIGN PATENT DOCUMENTS

| | | |
|---|---|---|
| GB | 1393333 | 10/1921 |
| GB | 1478853 | 12/1923 |

*Primary Examiner*—Richard Crispino
*Assistant Examiner*—Yewebdar T. Tadesse
(74) *Attorney, Agent, or Firm*—Barnes & Thornburg

(57) ABSTRACT

A coating system includes a source of electrically non-insulative coating material, a dispenser for dispensing the coating material toward an article to be coated thereby, and an electrostatic high potential supply for supplying charge to the coating material. The high potential supply is coupled across the dispenser and the article. The coating system further includes a reservoir, a valve having a housing providing first, second, third and fourth ports, and a component movable within the housing and having a first passageway selectively to connect the first port to the second port to permit the flow of coating material between the first port and the second port. Sensors sense: the flow rate of the eletrically non-conductive fluid and provide an indication when the flow rate of the eletrically non-conductive fliud falls outside a desired range—the pressure of the eletrically non-conductive fliud and provide an indication when the pressure of the eletrically non-conductive fliud falls outside a desired range; the pressure of the coating material and provide an indication when the pressure of the coating material falls outside a desired rande—and the current supplied from the potential supply to the valve and provide an indication when the current supplied from the potential supply to the valve falls outside a desired range.

8 Claims, 3 Drawing Sheets

U.S. PATENT DOCUMENTS 4,741,673 A 5/1988 Jubb
4,792,092 A 12/1988 Elberson et al.
4,878,622 A 11/1989 Jamison et al.
4,879,137 A 11/1989 Behr et al.
4,881,688 A 11/1989 Hankvist et al.
4,884,745 A 12/1989 Spongh
4,932,589 A 6/1990 Diana
4,962,724 A 10/1990 Prus et al.
4,982,903 A 1/1991 Jamison et al.
4,996,646 A * 2/1991 Farrington ..... 364/483
5,033,942 A 7/1991 Petersen
5,078,168 A 1/1992 Konieczynski
5,094,389 A 3/1992 Giroux et al.
5,096,126 A 3/1992 Giroux et al.
5,102,045 A 4/1992 Diana
5,102,046 A 4/1992 Diana
5,154,357 A 10/1992 Jamison et al.
5,193,750 A 3/1993 LaMontagne et al.
5,197,676 A 3/1993 Koniecyznski et al.
5,244,012 A 9/1993 Tabata et al.
5,249,748 A 10/1993 Lacchia et al.
5,255,856 A 10/1993 Ishibashi et al.
5,273,072 A 12/1993 Phillips
5,288,029 A 2/1994 Ishibashi et al.
5,288,525 A 2/1994 Diana
5,326,031 A 7/1994 Konieczynski
5,340,289 A 8/1994 Konieczynski et al.
5,341,990 A 8/1994 Konieczynski
5,364,035 A 11/1994 Ma et al.
5,632,816 A 5/1997 Allen et al.
5,746,831 A 5/1998 Allen et al.
5,787,928 A 8/1998 Allen et al.
5,796,184 A * 8/1998 Kuhnl et al. ..... 307/118

* cited by examiner

VOLTAGE BLOCK MONITORING SYSTEM

FIELD OF THE INVENTION

This invention relates to monitoring systems, and more particularly to systems for monitoring certain parameters of the operation of systems of the general type described in, for example, U.S. Pat. Nos. 5,632,816; 5,746,831; and 5,787,928. However, the system of the invention is believed to be useful in other applications as well. The disclosures of U.S. Pat. Nos. 5,632,816; 5,746,831; and 5,787,928 are hereby incorporated herein by reference.

BACKGROUND IF THE INVENTION

Many voltage blocks are illustrated and described in the prior art. There are, for example, the voltage blocks illustrated and described in U.S. Pat. Nos. 4,878,622; 4,982,903; 5,033,942; 5,154,357; and 5,193,750, and the references cited in those patents, particularly including U.S. Pat. No. 1,655,262; 2,547,440; 2,673,232; 3,098,890; 3,122,320; 3,291,889; 3,893,620; 3,933,285; 3,934,055; 4,017,029; 4,020,866; 4,085,892; 4,275,834; 4,313,475; 4,383,644; and, 4,413,788, and U.K. Patent Specifications 1,393,333 and 1,478,853. Also of interest are U.S. Patents: 2,814,551; 2,921,604; 3,419,827; 3,450,092; 3,838,946; 4,030,860; 4,232,055; 4,304,252; 4,381,180; 4,386,888; 4,515,516; 4,552,334; 4,741,673; 4,792,092; 4,879,137; 4,881,688; 4,884,745; 4,932,589; 4,962,724; 5,078,168; 5,094,389; 5,096,126; 5,102,045; 5,102,046; 5,105,851; 5,197,676; 5,244,012; 5,249,748; 5,255,856; 5,273,072; 5,288,029; 5,288,525; 5,326,031; 5,340,289; 5,341,990; and, 5,364,035. The disclosures of these references also are hereby incorporated herein by reference. No representation is intended by this listing that this is a complete listing of all pertinent prior art, or that a thorough search of all pertinent prior art has been conducted, or that no better prior art exists. Nor should any such representation be inferred.

DISCLOSURE OF THE INVENTION

According to the invention, a coating system includes a source of electrically non-insulative coating material, a dispenser for dispensing the coating material toward an article to be coated thereby, and an electrostatic high potential supply for supplying charge to the coating material. The high potential supply is coupled across the dispenser and the article. The coating system further includes a reservoir, a valve having a housing providing first, second, third and fourth ports, and a component movable within the housing and having a first passageway selectively to connect the first port to the second port to permit the flow of coating material between the first port and the second port. The first port is coupled to the coating material source. The second port is coupled to the reservoir. The third port is coupled to the dispenser. The component is movable within the housing selectively to connect the second port to the third port to permit the flow of coating material between the reservoir and the dispenser. The coating system includes a source of an electrically non-conductive fluid. The housing and the first movable component define between them a second passageway. The source of electrically non-conductive fluid is coupled to the fourth port to provide a flow of the electrically non-conductive fluid from the source of electrically non-conductive fluid through the second passageway to flush coating material from surfaces of the housing and movable component adjacent the second passageway.

According to one aspect of the invention, the apparatus further includes a sensor for sensing a flow rate of the electrically non-conductive fluid and providing an indication when the flow rate of the electrically non-conductive fluid falls outside a desired range.

According to another aspect of the invention, the apparatus further includes a sensor for sensing a pressure of the electrically non-conductive fluid and providing an indication when the pressure of the electrically non-conductive fluid falls outside a desired range.

According to another aspect of the invention, the apparatus further includes a sensor for sensing a pressure of the coating material and providing an indication when the pressure of the coating material falls outside a desired range.

According to another aspect of the invention, the apparatus further includes a sensor for sensing the current supplied from the potential supply through the valve and providing an indication when the current supplied from the potential supply through the valve falls outside a desired range.

According to another aspect of the invention, the apparatus further includes a source of compressed gas for use in operating at least one of the source of electrically non-insulative coating material, the dispenser, the reservoir, the valve, and the source of electrically non-conductive fluid. The source of compressed gas is coupled to the at least one of the source of electrically non-insulative coating material, the dispenser, the reservoir, the valve, and the source of electrically non-conductive fluid. A sensor is provided for sensing a pressure of the compressed gas and providing an indication when the pressure of the compressed gas falls outside a desired range.

BRIEF DESCRIPTION OF THE DRAWINGS

The invention may best be understood by referring to the following detailed description and accompanying drawings which illustrate the invention. In the drawings.

DETAILED DESCRIPTION OF ILLUSTRATIVE EMBODIMENTS

Figure 1:
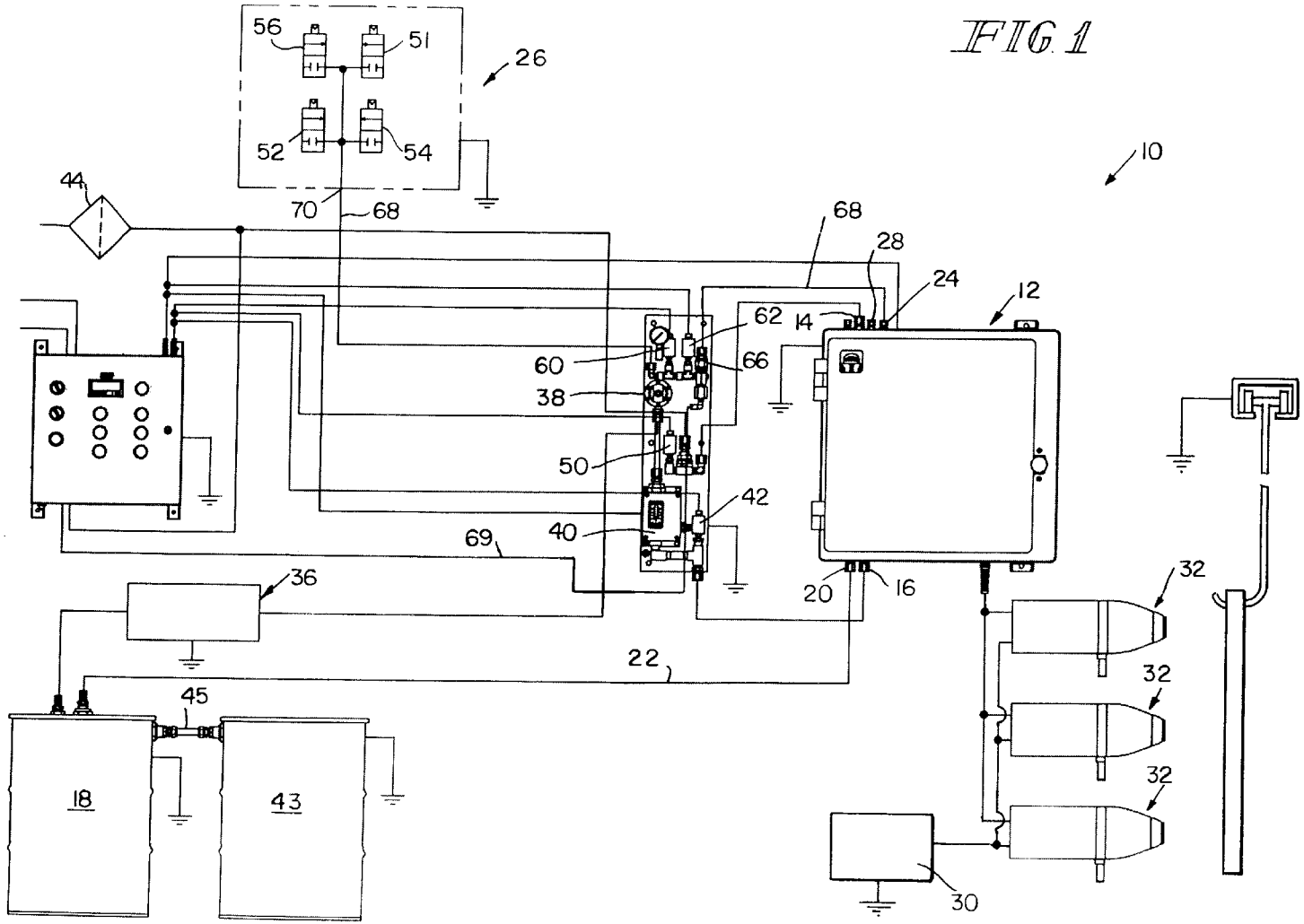
FIG. 1 illustrates schematically a system constructed according to the invention; and, FIGS. 2*a–b* illustrate diagrammatically methods of control of a system constructed according to the invention.

Referring to FIG. 1, a system 10 is provided for monitoring certain parameters of the operation of a voltage block system 12 of the general type illustrated in, for example, U.S. Pat. Nos. 5,632,816; 5,746,831; and 5,787,928. The system 10 monitors the system 12 current, supply air, coating material supply and the supply of voltage blocking medium. The current monitoring function monitors steady state current drawn by the system 12, and provides a fault indication if a steady state current exceeding an arbitrary limit, 40 $\mu$A in the illustrated system 10, is detected during a coating operation. The system 10 disregards current spikes which may occur during switching of the system 12 from one configuration to another. This can be accomplished by, for example, disabling the current sensing circuitry in system 10 during switching of the system 12 from one configuration to another. The system 10 alerts the operator of the need to change the blocking medium in system 12 when necessary, and of the need to change the molecular sieves, if present, in system 12 when necessary.

The system 10 monitors the supply of compressed air to the system 12 for all purposes for which it is required by system 12, such as, for example, to drive the coating material dispensing valve(s) of system 12 between their configurations. The air pressure monitoring function monitors the air pressure and provides a fault indication if the air pressure drops below an arbitrary limit, for example, 80 psig. Although the illustrated system 10 does not provide a fault indication if the air pressure exceeds any arbitrary limit, for example, 120 psig, such systems are within the contemplation of the present invention. As used herein "compressed air" means any suitable pressurized gas or mixture of gases (for example, helium, nitrogen or air) to which the various components of systems 10, 12 and materials used in systems 10, 12 are relatively unreactive.

System 10 also monitors the pressure of the coating material supplied to system 12 and provides a fault indication if the coating material pressure falls outside of an arbitrary range, for example, 20 psig.–100 psig (about $13.78\times10^4$ nt/m$^2$ gauge–about $6.89\times10_5$ nt/m$^2$ gauge). System 10 also monitors the volume of blocking medium flow in system 12, and provides a fault signal if the flow volume drops below some arbitrary limit, for example, 2 gallons per minute (about 7.57 liters per minute). Again, although the illustrated system 10 does not provide a fault indication for flow rates above some arbitrary limit, it is within the contemplation of the invention that system 10 could provide a fault signal if the flow volume fell outside of an arbitrary range, for example, 1 gpm–2 gpm (about 3.79 lpm–about 7.57 lpm). System 10 also monitors the blocking medium pressure and provides a fault indication when the blocking medium pressure exceeds some arbitrary limit, for example, 20 psig (about $13.78\times10^4$ nt/m$^2$ gauge). Again, although the illustrated system 10 does not provide a fault indication for blocking medium pressure below some arbitrary limit, it is within the contemplation of the invention that system 10 could provide a fault signal if the blocking medium pressure drops below some arbitrary limit, for example, 5 psig (about $3.45\times10^4$ nt/m$^2$ gauge).

A system 12 of the type described in, for example, U.S. Pat. Nos. 5,632,816; 5,746,831; and 5,787,928, includes a fitting 14 for coupling to a compressed air service, for example, <80 psig (about $5.51\times10^5$ nt/m$^2$ gauge), a fitting 16 for coupling to a source 18 of voltage blocking medium, a fitting 20 for coupling to a voltage blocking medium exhaust line 22, illustratively a return to source 18, a fitting 24 for coupling to a coating material color change manifold 26, and a fitting 28 for coupling to a high magnitude electrostatic potential source 30 interlock. This interlock provides to system 12 a signal when high magnitude electrostatic potential is being supplied from source 30 to coating material dispensing devices 32 which receive coating material dispensed by system 12, atomize that coating material, charge it electrostatically and dispense it onto articles to be coated by that atomized and charged coating material in accordance with known principles. The fluid lines which couple system 12 to system 10 should be maintained in the range of 18 inches to 24 inches (about 45.7 cm to about 61 cm) in length.

System 12 is coupled to source 18 of voltage blocking medium through a pump 36 which illustratively has a capacity of 15 gpm (about 57 lpm), a pressure regulator assembly 38, a flow switch 40 and a pressure switch 42. Illustratively, pressure regulator assembly 38 is set to provide a maximum voltage blocking medium pressure in the circuit supplying voltage blocking medium to system 12 of, for example, 20 psig (about $13.78\times10^4$ nt/m$^2$ gauge). Pressure switch 42 provides a fault signal from system 10 if this maximum desired circuit pressure is exceeded. The flow switch 40 provides a fault signal from system 10 if the voltage blocking medium flow rate falls below a desired minimum. Voltage blocking medium is returned via fitting 20 and voltage blocking medium exhaust line 22 to source 18. Because some small amount of the coating material remaining in system 12 may be rinsed from system 12 into the voltage blocking medium circulating in circuit 18, 16, 20, 12, 22, 18, the volume of material in this circuit may increase somewhat over the useful life of the voltage blocking medium in source 18. Consequently, it may be desirable to provide an overflow container 43 coupled by, for example, a straight, short length of polyethylene tubing 45, to source 18.

System 12 is coupled to the compressed air service through an air filter 44 coupled to fitting 14 through a pressure switch 50. System 12 provides a signal to system 10 which then generates a fault signal if the air pressure falls below a set value, for example, 80 psig (about $5.51\times10^5$ nt/m$^2$ gauge).

Coating material color change manifold 26 illustratively includes three color valves 51, 52 and 54 and a solvent valve 56. Solvent valve 56 dispenses an electrically conductive solvent, for example, water, into system 12 to rinse prechange color remaining in system 12 from it prior to the beginning of a dispensing cycle of a new color. Of course, any number of color valves can be provided on manifold 26 to permit dispensing any desired number of colors. Coating material color change manifold 26 is coupled to system 12 through both low and high pressure switches 60, 62, respectively. Switch 60 provides a fault signal from system 10 if the coating material pressure falls below, for example, 20 psig (about $1.38\times10^5$ nt/m$^2$ gauge). Switch 62 provides a fault signal from system 10 if the coating material pressure exceeds, for example, 100 psig (about $6.89\times10^5$ nt/m$^2$ gauge). An air piloted coating material valve 66 is provided in the line 68 by which manifold 26 is coupled to system 12. Valve 66 is operated by a signal from system 10 on line 69 which indicates the absence or presence of any of the above noted faults. In addition, in the illustrated embodiment, a grounded fitting 70 is provided in line 68 between valve 66 and system 12.

In the illustrated embodiment, all of components 18, 24, 26, 36, 38, 40, 42, 43 and 70 are coupled to electrical ground for the reasons noted in U.S. Pat. Nos. 5,632,816; 5,746,831; and 5,787,928.

Figure 2A:
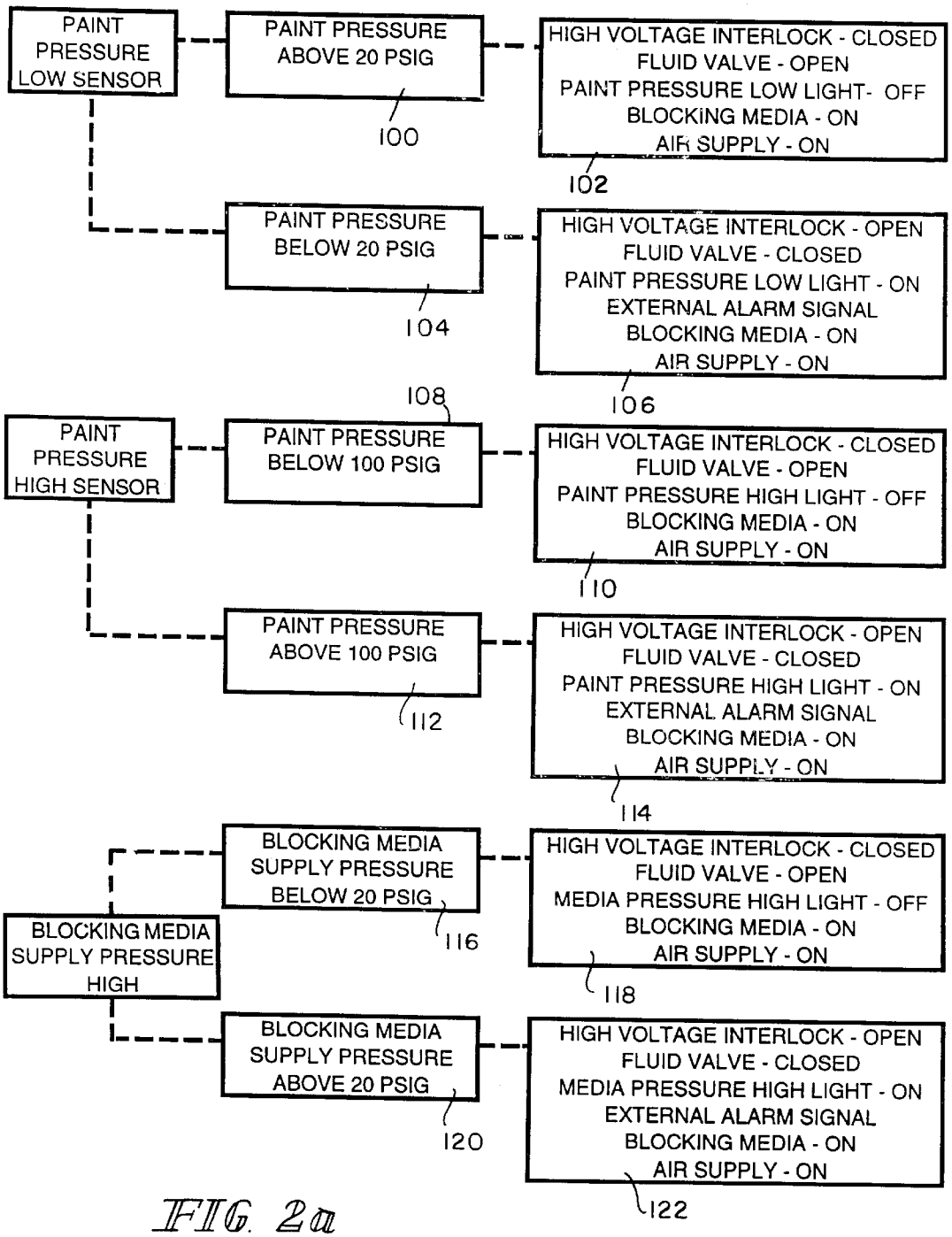
Figure 2B:
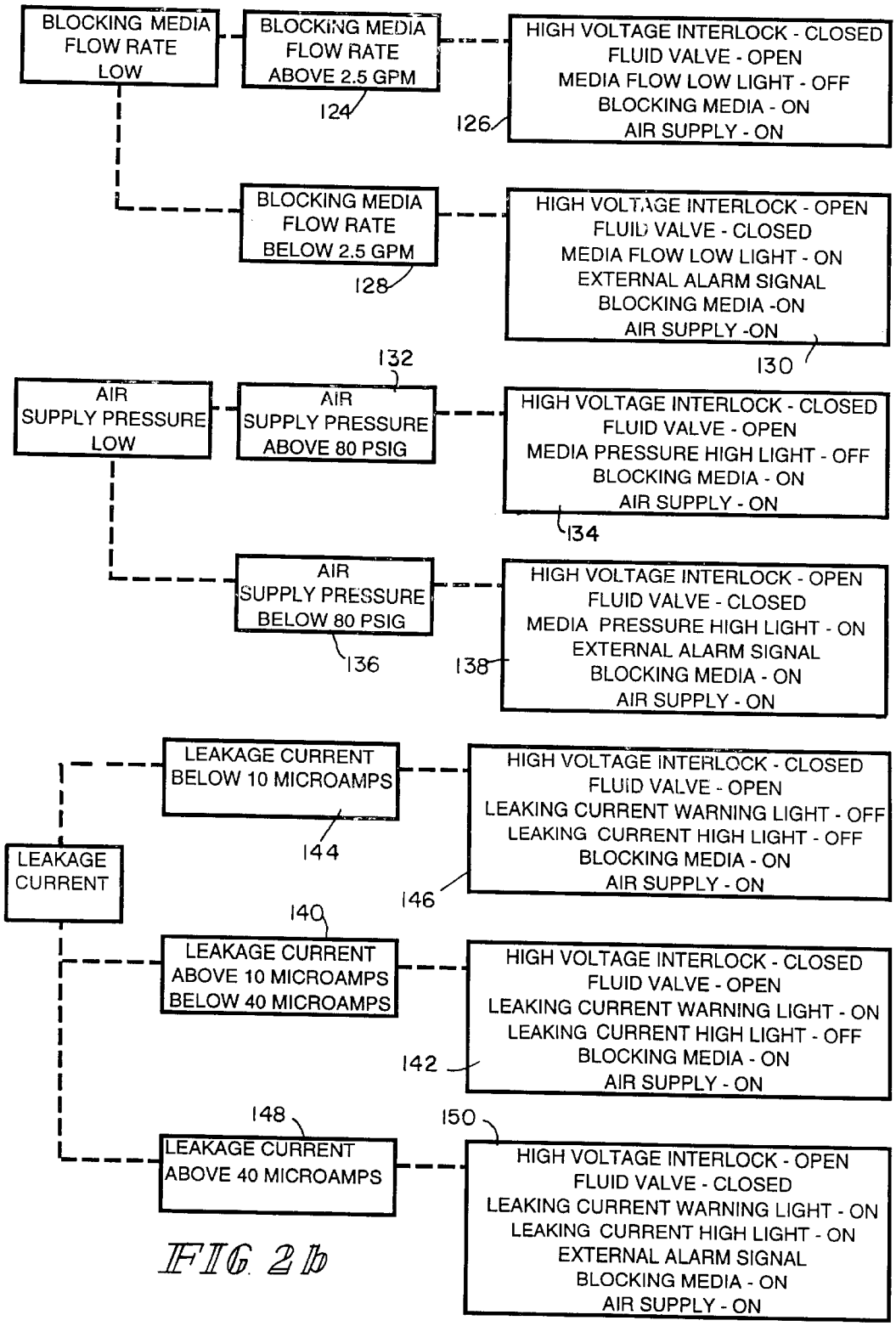

Control of system 12 by system 10 is illustrated diagrammatically in FIGS. 2*a–b*. Referring first to FIG. 2*a*, the coating material low and high pressure sensors 60 and 62 provide signals to the high voltage interlock of high magnitude voltage supply 30 and to the coating material valve 66. If the coating material pressure is above its minimum control pressure, 20 psig (about $13.78\times10^4$ nt/m$^2$ gauge) in the illustrated embodiment, decision 100, the high voltage interlock is closed, permitting high voltage to be supplied from high magnitude potential supply 30 to dispensing devices 32. The coating material valve 66 is open, permitting coating material to be supplied to system 12. Paint pressure low and paint pressure high warning lamps on an operator control panel are off The voltage blocking medium pump 36 is on, circulating voltage blocking medium around its circuit 18, 16, 20, 12, 22, 18, and compressed air is being supplied through its circuit 44, 46. This is action 102. If the coating material pressure should fall below its lower limit for any reason, the system 10 switches state. This is decision 104. The high voltage interlock is closed, halting the supply of high magnitude potential from supply 30 to dispensing devices 32. Valve 66 is closed, halting the flow of coating material to system 12. If the coating material pressure is below the lower control limit, the paint pressure low lamp is lighted, indicating this condition to an operator. An additional alarm is sounded calling attention to the out of control range condition. Blocking medium and compressed air continue to be supplied to system 12. This is action 106.

If the coating material pressure is below the upper limit of its control range, 100 psig (about $6.89\times10^5$ nt/m$^2$ gauge) in the illustrated embodiment, decision 108, the high voltage interlock is closed, permitting high voltage to be supplied from high magnitude potential supply 30 to dispensing devices 32. The coating material valve 66 is open, permitting coating material to be supplied to system 12. Paint pressure high warning lamp on the operator control panel is off The voltage blocking medium pump 36 is on, circulating voltage blocking medium around its circuit 18, 16, 20, 12, 22, 18, and compressed air is being supplied through its circuit 44, 46. This is action 110. If the coating material pressure should exceed the upper limit of its control range, 100 psig (about $6.89\times10^5$ nt/m$^2$ gauge) in the illustrated embodiment, the system 10 switches state. This is decision 112. The high voltage interlock is opened, halting the supply of high magnitude potential from supply 30 to dispensing devices 32. Valve 66 is closed, halting the flow of coating material to system 12. The paint pressure high lamp is lighted, indicating this condition to an operator. An alarm is sounded calling attention to the out of control range condition.

Blocking medium and compressed air continue to be supplied to system 12. This is action 114.

If the blocking medium supply pressure is within its control limits, $\leqq$20 psig (about $13.78\times10^4$ nt/m$^2$ gauge) or below in the illustrated embodiment, decision 116, the high voltage interlock is closed, permitting high voltage to be supplied from high magnitude potential supply 30 to dispensing devices 32. The coating material valve 66 is open, permitting coating material to be supplied to system 12. The voltage blocking medium pressure high lamp is off. The voltage blocking medium pump 36 is on, circulating voltage blocking medium around its circuit 18, 16, 20, 12, 22, 18, and compressed air is being supplied through its circuit 44, 46. This is action 118. If the blocking medium supply pressure is outside its control limits, >20 psig (about $13.78\times10^4$ nt/m$^2$ gauge) in the illustrated embodiment, decision 120, the high voltage interlock is open. The coating material valve 66 is closed. The voltage blocking medium pressure high lamp is lighted, indicating this condition to an operator. An additional alarm is sounded calling attention to the out of control range condition. Blocking medium and compressed air continue to be supplied to system 12. This is action 122.

Referring now to FIG. 2*b*, if the flow rate of the voltage blocking medium falls within the control range, $\geqq$2.5 gpm (about 9.48 lpm) in the illustrated embodiment, decision 124, the high voltage interlock is closed, permitting high voltage to be supplied from high magnitude potential supply 30 to dispensing devices 32. The coating material valve 66 is open, permitting coating material to be supplied to system 12. The voltage blocking medium flow rate warning lamp is off. The voltage blocking medium pump 36 is on, circulating voltage blocking medium around its circuit 18, 16, 20, 12, 22, 18, and compressed air is being supplied through its circuit 44, 46. This is action 126. If the flow rate of voltage blocking medium falls outside its control range, decision 128, the high voltage interlock is open. The coating material valve 66 is closed. The voltage blocking medium flow rate warning lamp is lighted, indicating this condition to an operator. An additional alarm is sounded calling attention to the out of control range condition. Blocking medium and compressed air continue to be supplied to system 12. This is action 130.

If the compressed air supply pressure is within its control limits $\geqq$80 psig (about $5.51\times10^5$ nt/m$^2$ gauge) in the illustrated embodiment, decision 132, the high voltage interlock is closed, permitting high voltage to be supplied from high magnitude potential supply 30 to dispensing devices 32. The coating material valve 66 is open, permitting coating material to be supplied to system 12. The compressed air supply pressure warning lamp is off. The voltage blocking medium pump 36 is on, circulating voltage blocking medium around its circuit 18, 16, 20, 12, 22, 18, and compressed air is being supplied through its circuit 44, 46. This is action 134. If the compressed air supply pressure is outside its control limits, <80 psig (about $5.51\times10^5$ nt/m$^2$ gauge) in the illustrated embodiment, decision 136, the high voltage interlock is open. The coating material valve 66 is closed. The compressed air supply pressure warning lamp is lighted, indicating this condition to an operator. An additional alarm is sounded calling attention to the out of control range condition. Blocking medium and compressed air continue to be supplied to system 12. This is action 138.

Finally, if the leakage current I, is within the control range, 10 $\mu$A$\leqq I_l \leqq$40 $\mu$A, decision 140, the high voltage interlock is closed, permitting high voltage to be supplied from high magnitude potential supply 30 to dispensing devices 32. The coating material valve 66 is open, permitting coating material to be supplied to system 12. The leakage current warning lamp is on, but the leakage current high warning lamp is off The voltage blocking medium pump 36 is on, circulating voltage blocking medium around its circuit 18, 16, 20, 12, 22, 18, and compressed air is being supplied through its circuit 44, 46. This is action 142. If the leakage current $I_l$ is $\leqq$10 $\mu$A, decision 144, the high voltage interlock is closed, permitting high voltage to be supplied from high magnitude potential supply 30 to dispensing devices 32. The coating material valve 66 is open, permitting coating material to be supplied to system 12. The leakage current warning lamp and the leakage current high warning lamp are both off The voltage blocking medium pump 36 is on, circulating voltage blocking medium around its circuit 18, 16, 20, 12, 22, 18, and compressed air is being supplied through its circuit 44, 46. This is action 146. If the leakage current $I_l$ is >40 $\mu$A, decision 148, the high voltage interlock is open. The coating material valve 66 is closed. The leakage current warning lamp and the leakage current high warning lamp are both lighted, indicating this condition to an operator. An additional alarm is sounded calling attention to the out of control range condition. Blocking medium and compressed air continue to be supplied to system 12. This is action 150.

What is claimed is:

1. A coating system including a source of electrically non-insulative coating material, a dispenser for dispensing the coating material toward an article to be coated thereby, an electrostatic high potential supply for supplying charge to the coating material, the high potential supply being coupled across the dispenser and the article, a reservoir, a valve having a housing, the housing providing first, second, third and fourth ports, and a component movable within the housing and having a first passageway selectively to connect the first port to the second port to permit the flow of coating material between the first port and the second port, the first port being coupled to the coating material source, the second port being coupled to the reservoir, the third port being coupled to the dispenser, the component being movable within the housing selectively to connect the second port to the third port to permit the flow of coating material between the reservoir and the dispenser, a source of an electrically non-conductive fluid, the housing and the first movable component defining between them a second passageway, the source of electrically non-conductive fluid being coupled to the fourth port to provide a flow of the electrically non-conductive fluid from the source of electrically non-conductive fluid through the second passageway to flush coating material from surfaces of the housing and movable component adjacent the second passageway, and a sensor for sensing the current supplied from the potential supply to the first valve and providing an indication when the current supplied from the potential supply to the first valve falls outside a desired range.

2. The apparatus of claim 1 further including a sensor for sensing a flow rate of the electrically non-conductive fluid and providing an indication when the flow rate of the electrically non-conductive fluid falls outside a desired range.

3. The apparatus of claim 1 further including a sensor for sensing a pressure of the coating material and providing an indication when the pressure of the coating material falls outside a desired range.

4. The apparatus of claim 1 further including a sensor for sensing a pressure of the electrically non-conductive fluid and providing an indication when the pressure of the electrically non-conductive fluid falls outside a desired range.

5. The apparatus of claim 2 further including a sensor for sensing a pressure of the coating material and providing an indication when the pressure of the coating material falls outside a desired range.

6. The apparatus of claim 2 further including a sensor for sensing a pressure of the electrically non-conductive fluid and providing an indication when the pressure of the electrically non-conductive fluid falls outside a desired range.

7. The apparatus of claim 3 further including a sensor for sensing a pressure of the electrically non-conductive fluid and providing an indication when the pressure of the electrically non-conductive fluid falls outside a desired range.

8. The apparatus of claim 5 further including a sensor for sensing a pressure of the electrically non-conductive fluid and providing an indication when the pressure of the electrically non-conductive fluid falls outside a desired range.

* * * * *